US005734162A

United States Patent [19]

Dowell

[11] Patent Number: 5,734,162

[45] Date of Patent: Mar. 31, 1998

[54] METHOD AND APPARATUS FOR SELECTIVELY TRAPPING IONS INTO A QUADRUPOLE TRAP

[75] Inventor: Jerry T. Dowell, Portola Valley, Calif.

[73] Assignee: Hewlett Packard Company, Palo Alto, Calif.

[21] Appl. No.: 641,260

[22] Filed: Apr. 30, 1996

[51] Int. Cl.[6] ..... H01J 49/42

[52] U.S. Cl. ..... 250/292; 250/282

[58] Field of Search ..... 250/292, 293, 250/291, 290, 281, 282

[56] References Cited

U.S. PATENT DOCUMENTS

| | | | |
|---|---|---|---|
| 4,755,670 | 7/1988 | Syka et al. | 250/292 |
| 4,945,234 | 7/1990 | Goodman et al. | 250/292 |
| 5,089,703 | 2/1992 | Schoen et al. | 250/292 |
| 5,347,127 | 9/1994 | Franzen | 250/292 |
| 5,381,007 | 1/1995 | Kelley | 250/282 |
| 5,436,445 | 7/1995 | Kelley et al. | 250/292 |
| 5,561,291 | 10/1996 | Kelley et al. | 250/292 |

OTHER PUBLICATIONS

March et al., "Resonance Excitation of Ions Stored in a Quadrupole Ion Trap, Part II. Further Simulation Studies," Inr'l J. of Mass Spectrometry and Ion Porcesses, 99 (1990) 109–124.

March et al. "Resonance Excitation of Ions Stored in a Quadrupole Ion Trap. Part I. A Simulation Study," Int'l J. of Mass Spectrometry and Ion Processes, 95 (1989) 119–156.

*Primary Examiner*—Kiet T. Nguyen

[57] ABSTRACT

Selective trapping of ions from an external source into a quadrupole trap is accomplished by applying a parametric pump voltage to the quadrupole trap electrodes in such a phase as to extract energy from the ions, causing the ions to accumulate in the center of the trap. Pump voltage phase is controlled by the timing of the injection of ions into the trap relative to the absolute phase of the pump voltage. Optimum phasing results when the ion packet allowed into the trap through gating of the ion beam optics is sufficiently opposed by the field produced by the parametric pump voltage. The ions are also subjected to a normal RF trapping field.

16 Claims, 3 Drawing Sheets

METHOD AND APPARATUS FOR SELECTIVELY TRAPPING IONS INTO A QUADRUPOLE TRAP

BACKGROUND OF THE INVENTION

1. Technical Field

The invention relates to ion trap mass spectrometry. More particularly, the invention relates to a method and apparatus for selectively trapping ions into a quadrupole trap.

2. Description of the Prior Art

Quadrupole ion trap technology is increasingly used in the field of mass spectrometry. FIG. 1 is a schematic diagram of a typical three-dimensional quadrupole ion trap. A quadrupole ion trap 10 typically consists of three electrodes having hyperbolic surfaces, i.e. a ring electrode 12 and two end caps 14, 16.

In general, a voltage U+V cos$\Omega$t is applied between the ring electrode and the end caps. For certain ranges of values for U, V, and $\Omega$, ions of a given mass or a range of masses can be trapped in the region between the electrodes. The ions can be either created in the trap, e.g. by electron bombardment of neutral gas in the trap, or they can be introduced into the trap from an external source. Trapping is facilitated by introducing a buffer gas into the trap. Such gas can comprise, for example up to one millitorr of helium. The ions so trapped are thermalized by collisions with the gas. Removal of excess kinetic energy from the ions is especially important in the case of an external ion source. This is conventionally accomplished by collisions with the buffer gas. Thermalization times increase as the mass of the desired ions increases.

It would be desirable to provide a technique that reduces the thermalization time of ions that are trapped in a quadrupole ion trap.

SUMMARY OF THE INVENTION

The invention provides a means for selectively trapping ions from an external source into a quadrupole trap. Trapping is accomplished by applying a parametric pump voltage to the quadrupole trap electrodes in such a phase as to extract energy from the ions, causing the ions to accumulate in the center of the trap. The pump voltage phase is controlled by the timing of the injection of ions into the trap relative to the absolute phase of the pump voltage. Optimum phasing results when the motion of the ion packet allowed into the trap through gating of the ion beam is on the average opposed more than aided by the field produced by the parametric pump voltage. In addition, the ions are subjected to a normal RF trapping field. Advantages of parametric trapping include improved selectivity and speed.

DETAILED DESCRIPTION OF THE INVENTION

The invention provides a technique in which ions are gated into an ion trap. Such gating (discussed in greater detail below) is an optional step that is provided in the preferred embodiment of the invention. The gated ions are subjected to parametric resonance within the trap that extracts energy from the ions to thereby facilitate rapid ion trapping. Once the ions are trapped in this way, they can be ejected for analysis. To effect such ejection, methods can be employed as are known in the art and may include, for example modification of the magnitude, frequencies, or phases of the fields created by the potentials applied to the trap electrodes.

Figure 1:
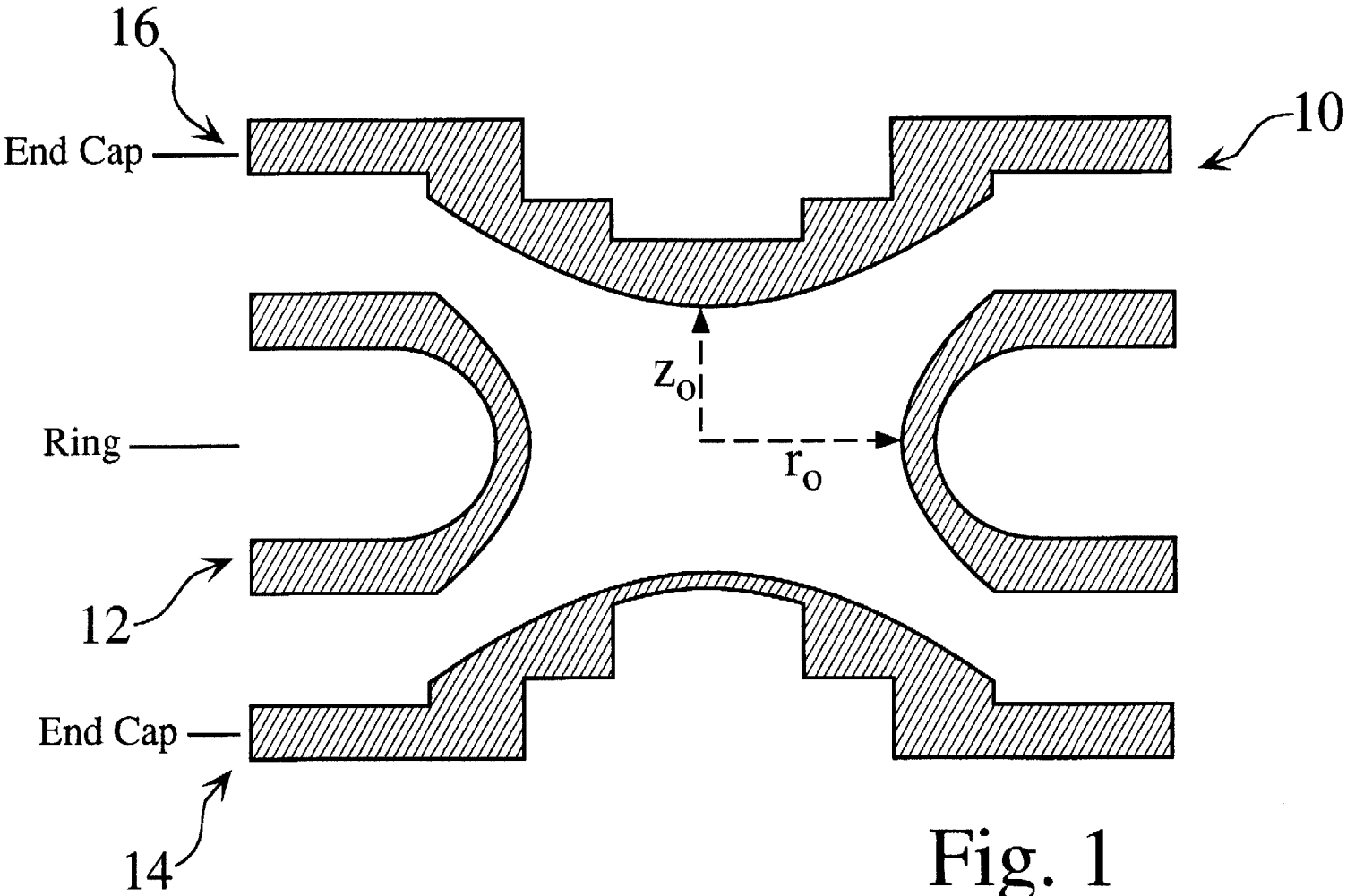
Fig. 1 (PRIOR ART)
FIG. 1 is a schematic diagram of a three-dimensional quadrupole ion trap.
Figure 2:
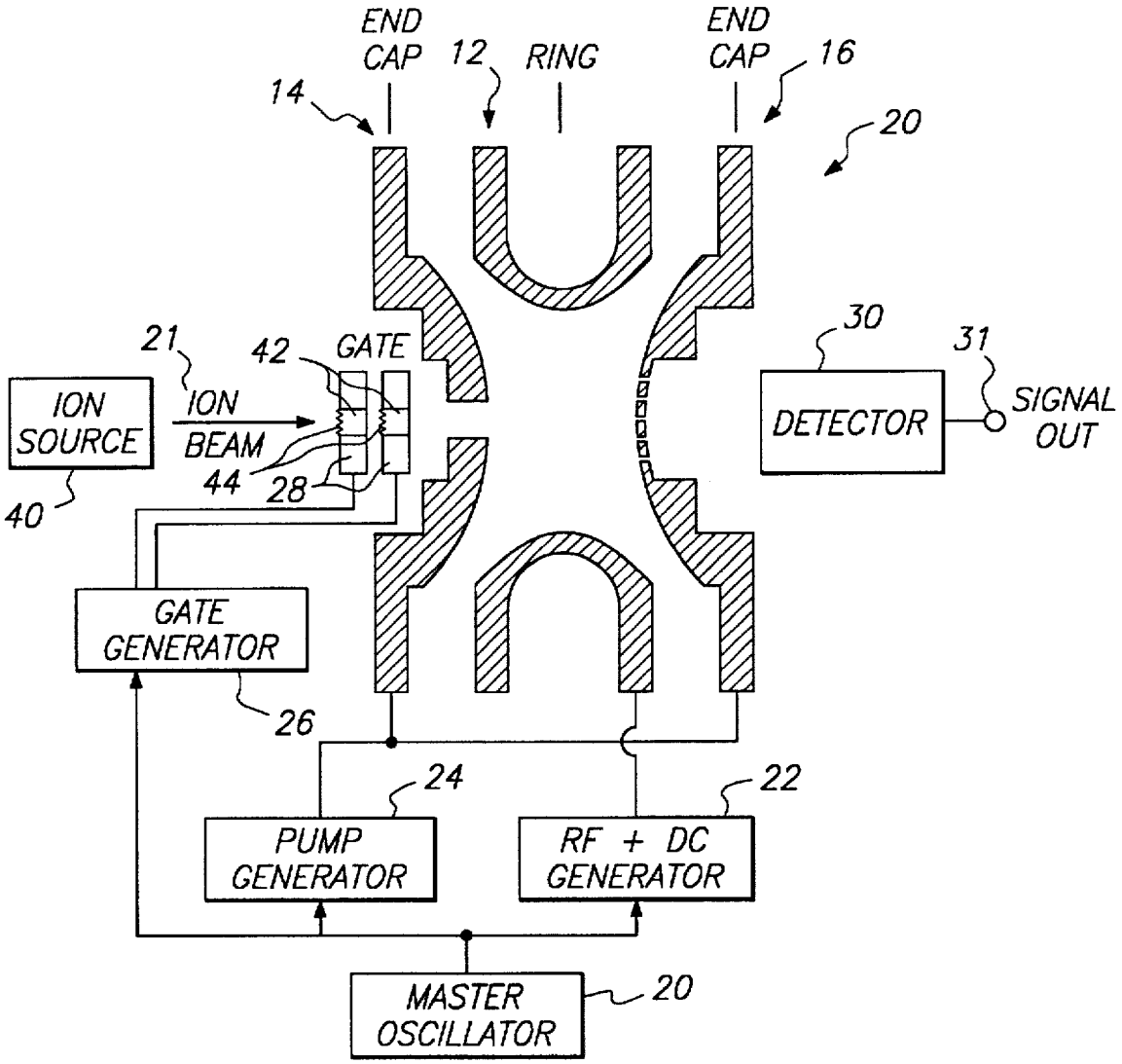
FIG. 2 is a schematic diagram of a quadrupole ion trap mass spectrometer having two applied voltages resulting in quadrupolar fields according to the invention.

FIG. 2 is a schematic diagram of a quadrupole ion trap mass spectrometer 20 having two applied voltages resulting in quadrupolar fields according to the invention. The RF+DC voltage for confinement is produced by an RF+DC generator 22 and applied to the ring electrode 12; and the pump voltage is produced by a pump generator 24 and applied in a unipolar fashion to the endcaps 14, 16. The pump generator is preferably an AC signal source, or it may be an RF signal source. The signal is preferably synthesized because it is desirable to be able to vary the signal phase and thereby set an optimum signal phase for ion trapping.

Both voltages are assumed to be referenced to ground. It should be noted that there are many ways to apply the various potentials to the electrodes. See, for example R. E. March, et al, *Resonance Excitation of Ions Stored In A Quadrupole Ion Trap*. Part 1. *A simulation Study*, Int. J. Mass Spectrum. Ion Proc., 95, 119 (1989). For this particular configuration, the AC pump voltage at frequency $\omega$ is applied to the electrodes such as to result in a quadrupolar field. The two quadrupolar fields, at frequencies $\Omega$ and $\omega$, are superposed.

In the preferred embodiment of the invention, all AC and RF supplies, including the input optics gate generator 26, are derived from a master oscillator 20, so that all voltages are phase-coherent. It should be noted that phase-coherence can be accomplished by any of several means, such as using supplies with ultra-high frequency stability for each voltage. For example, a means may be provided for phasing, i.e. adjusting the timing, of the various voltages with respect to each other. The trap 20, detector 30, and ion beam 21 are mounted in an appropriate high-vacuum chamber that may be a single chamber or a multi-chambered vessel having one or more vacuum pumps (not shown) as is known in the art.

A beam of ions 21, for example from an electrospray or an atmospheric pressure ionization (API) source, 40 (FIG. 2) is directed toward the trap 20 and, if electrode voltages are favorable, may enter the trap through a small, screened hole in an endcap. The beam may be bunched electronically, but this is not essential to the invention. Ions that are allowed to enter the trap are subjected to the two quadrupole fields, i.e. to the superposition of the two fields.

As discussed above, one feature of the invention provides a gate generator for gating the ions into the ion trap. The gate generator is provided to gate the ions into the trap as a bundle, thereby maintaining a proper relationship of ion motion to the phase of the parametric voltage. While in principle, it is possible to allow the ions to enter the trap continuously, the result is that only some of the ions are trapped and other ions are driven even further out of the trap, such that ion collection efficiency is reduced. Thus, the gate generator is helpful to synchronize the admission of ions into the trap with the pulsing of the pump generator.

The gate generator is preferably a source of pulsed DC voltage that has a variable pulse width, pulse height, and repetition rate. The gate itself can be a simple electrode 28 (FIG. 2) having circular or rectangular hole 42 (FIG. 2)

formed therethrough. Alternatively, the gate can be an electrode having a hole that is covered with a mesh 44 (FIG. 2); or it can be a set of more than one electrode 28 (FIG. 2) that operates as a gate if one wants to bunch the ions into a smaller Z-axis bundle. For example, one could provide a series of electrodes 28 (FIG. 2) having a sequence of gate pulses that bunch the ions as they enter the trap. Such gate would be useful for focusing the position and/or energy of the ions.

If only the confinement field is applied, the ions execute motions that are oscillatory with frequencies:

$$\omega_{u,n} = (n + \beta_u/2)\Omega \qquad n = -\infty, \ldots, -1, 0, 1, \ldots, \infty \qquad u = r \text{ or } z \tag{1}$$

For purposes of the discussion herein, only the fundamental frequencies are considered, with n=0. It should be understood that the actual motions of ions in the trap are superpositions of motions with many frequency components. Thus, the following:

$$\omega_r = \beta_r\Omega/2; \text{ and} \tag{2}$$

$$\omega_z = \beta_z\Omega/2 \tag{3}$$

define the dominant frequencies of secular motion in the trap. The β terms are functions of the appropriate a and q as follows:

$$a_r = \frac{4eU}{mr_0^2\Omega^2}, \tag{4}$$

$$q_r = \frac{-2eV}{mr_0^2\Omega^2}, \tag{5}$$

$$a_z = \frac{-8eU}{mr_0^2\Omega^2}, \tag{6}$$

and $$q_z = \frac{4eU}{mr_0^2\Omega^2} \tag{7}$$

Figure 3:
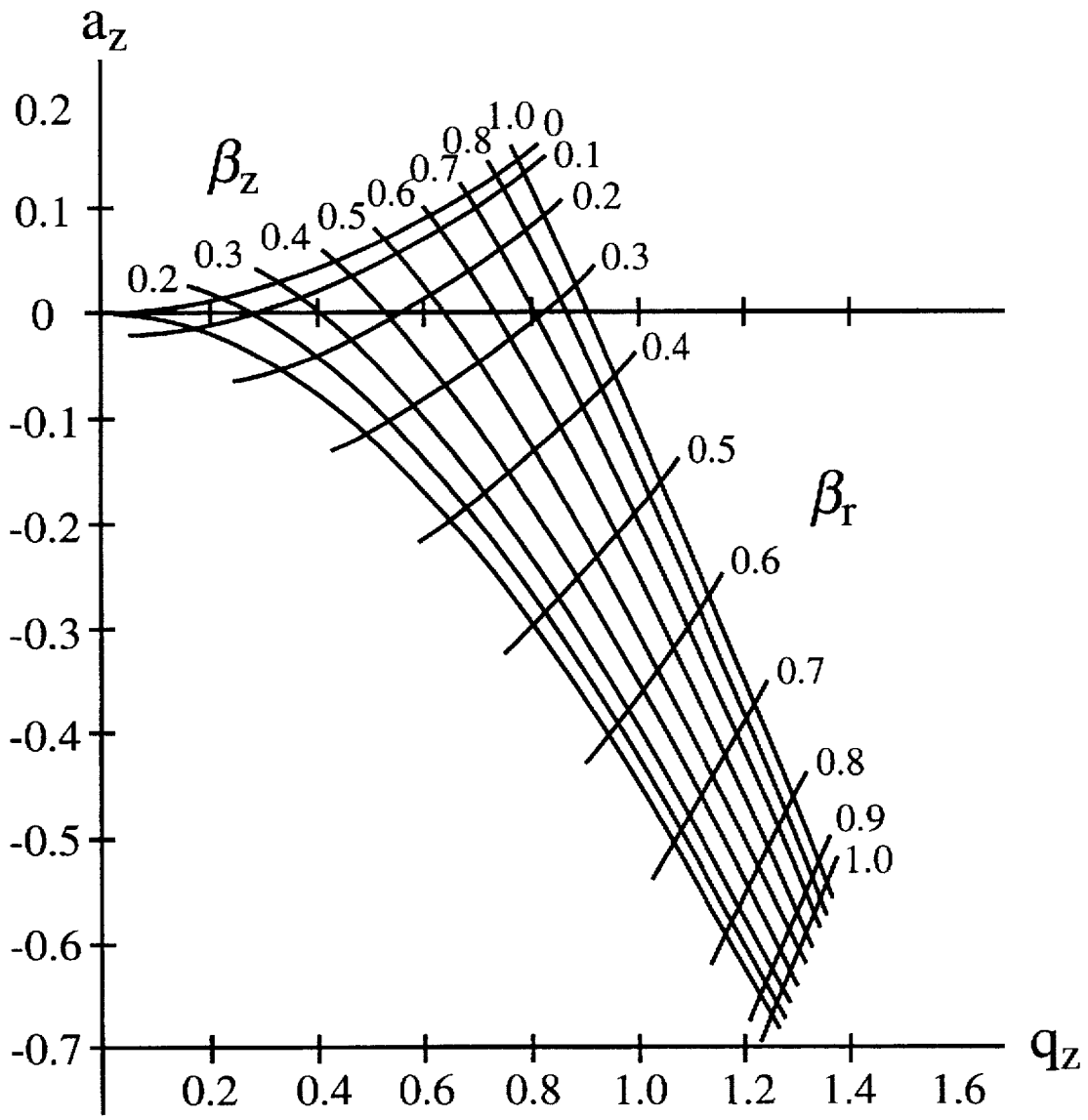
FIG. 3 is graph plotting a stability region near the origin for the three dimensional ion trap of FIG. 2 showing the iso-$\beta$ lines according to the invention.

Motion of the ions is stable, and ions can be trapped, only for certain ranges of a,q values, namely those for which the terms $\beta_r$ and $\beta_z$ are between 0 and 1 (see, for example FIG. 3 which is a graph plotting a stability region near the origin for the three dimensional ion trap of FIG. 2 showing the iso-β lines according to the invention). Expressions relating $\beta_u$ to $q_u$ and $q_u$ in terms of continued fractions are well known in the art and found in standard references.

FIG. 3 shows a plot of ion trap parameters with an axis (a) that is proportional to the DC voltage applied to the trap and an axis (q) that is proportional to the AC trapping voltage. The normal method of operating an ion trap in mass spectroscopy involves trap operation along the q axis. In other words, when no DC voltage is applied, ion parameters define a point that moves back and forth on the q-axis as the AC trapping voltage is varied. For example, one could provide a linearly increasing AC voltage that scans the ions out as the ions reach the far right intersection on the $\beta_z$=1 line with the q-axis. At that point the ions enter a region of instability. Because the q is inversely proportional to the mass, the ion trap scans out higher and higher masses as the voltage is increased.

There are various resonance points along the q-axis at which one can apply auxiliary voltages to bring an ion into resonance. Thus, even though the ion is within the stability region, it can be excited and gain motion that ejects it from the trap. The secular frequencies of motion for the r coordinate and the z coordinate are discussed above.

In the prior art, the second field is applied at one of the secular motion frequencies, usually $\omega_z$. Most often, the second voltage is applied to the endcaps as a dipolar field, rather than a quadrupolar field. This causes the ions appropriate to that secular frequency to be excited and to execute motion of ever-increasing amplitude, eventually being driven out of the trap. Ramping of the frequency of the supplementary voltage results in scanning out the ions sequentially by mass.

Application of supplementary voltages having frequencies other than those of the secular motions can result in energy transfer to or from the ions in the field. In particular, strong effects can occur if the frequency of the supplementary voltage is twice that of one of the secular frequencies, i.e. 2 $\omega_r$ or 2 $\omega_z$. This is referred to as parametric resonance. See, for example R. E. March, et al., ibid.; and L. D. Landau, E. M. Lifshitz, *Mechanics*, 3rd Ed., Pergamon, 1976, pp. 80ff.

Ion ejection from the trap by parametric resonance has been found to be very effective. For example, parametric resonance is faster than ion ejection techniques that apply voltages at the secular frequencies, or that raise the a and/or q terms to values that are outside the stability region by increasing the confinement DC or AC voltage magnitude.

Ejection of ions by parametric resonance occurs only over a certain range of phase of the parametric voltage with respect to the motions of those ions. The invention herein exploits to advantage the fact that for other ranges of phases, the ions give up energy, and their motion is damped. Such damping has been neglected in the prior art. The invention uses such parametric resonance damping to assist the process of initially trapping the ions. In the presently preferred embodiment of the invention, the proper phase relationship is accomplished by appropriate electronic timing of ion introduction into the trap with the phase of the parametric voltage.

Such parametric resonance damping yields an exponential decrease in the amplitude of ion motion, providing much faster trapping than that provided by the use of gas collisions. Such damping is also mass-selective because each species of ion only responds to its particular parametric resonance frequency. Thus, the trap is not filled with interfering species, and maximum sensitivity is realized for the species of interest. The trapped ions can then be analyzed further by such known techniques as, for example MS/MS or $MS^n$ (see, for example R. E. March, J. F. J. Todd, *Practical Aspects of Ion Trap Mass Spectrometry, Volume I, Fundamentals Of Ion Trap Mass Spectrometry*, CRC Press, 1995).

More than one species of ion can be trapped simultaneously by applying a parametric field having a complex waveform containing the proper frequency components for the various species of ion, each frequency being applied with the proper phase. Parametric pump voltages can also be applied to produce dipolar fields, which also function to damp the ion motion. It is thought that it is also possible to perform parametric pumping and damping in a trap by use of a pump voltage, together with energy trap circuitry at the idler frequency, in analogy with a parametric amplifier. See, for example L. A. Blackwell, K. L. Kotebue, *Semiconductor-Diode Parametric Amplifiers*, Prentice-Hall, 1961; and W. H. Louisell, *Coupled Mode and Parametric Electronics*, John Wiley & Sons, 1960.

Additionally, the parametric pump voltage may be pumped in a burst, i.e. by turning the voltage on at a definite time with respect to the ion entrance optics pulsing, and then turning the voltage off at an advantageous time. In this embodiment of the invention, it is preferred to terminate the pump before sufficient dephasing occurs to cause the ions to undergo parametric excitation, and to thereby be ejected from the trap. The initiation time of the parametric voltage burst is preferably tailored to an optimum position of the ion bunch in the trap, which also depends upon the ion kinetic energy.

Although the invention is described herein with reference to the preferred embodiment, one skilled in the art will readily appreciate that other applications may be substituted for those set forth herein without departing from the spirit and scope of the invention. For example, although a specific trap structure has been described herein in connection with the preferred embodiment of the invention, the invention is not limited to a so-called Paul trap which is a trap containing two sets of hyperbolic surfaces, but also has application for such structures as, for example a linear quadrupole trap, i.e. a quadrupole mass filter having electrodes at the ends. The use of parametric frequencies herein described may be applied to assist the trapping in, or ejection from, such a trap. With regard to such structures, see A. Schoen, J. Syka, *Method and Apparatus For Mass Analysis In A Multipole Mass Spectrometer,* U.S. Pat. No. 5,089,703 (18 Feb. 1992); and Syka, W. Fies, *Fourier Transform Quadrupole Mass Spectrometer and Method,* U.S. Pat. No. 4,755,670 (5, Jul. 1988), in which they are using such structures with auxiliary voltages, but not necessarily parametric voltage and certainly not parametric trapping. Accordingly, the invention should only be limited by the Claims included below.

I claim:

1. An ion trapping method, said method comprising:

introducing ions into an ion trap and subjecting said ions to parametric resonance within said ion trap to extract energy from said ions and thereby facilitate rapid ion trapping wherein the timing of ion introduction into said trap with the phase of said parametric resonance results in extraction of energy from said ions.

2. The method of claim 1, wherein the step of introducing ions into said ion trap comprises gating said ions into said ion trap, wherein a proper phase relationship is accomplished by appropriate said timing of ion introduction into said trap with the phase of said parametric resonance such that the motion of the ions into the trap is on the average opposed more than aided by the field produced by the parametric resonance.

3. The method of claim 1 wherein said ions are analyzed by ejection from said ion trap to an ion detector.

4. A method for trapping ions in a quadrupole ion trap mass spectrometer having a ring electrode and one or more endcap electrodes, said method comprising:

providing an ion source;

producing an RF+DC voltage;

applying said RF+DC voltage to said ring electrode resulting in a first field that provides ion confinement;

producing a pump voltage; and applying said pump voltage in a unipolar fashion to said one or more endcap electrodes resulting in a second field;

wherein ions that are allowed to enter said ion trap are subjected to a superposition of said first and second fields to produce a parametric resonance within said ion trap that extracts energy from said ions and thereby facilitates rapid ion trapping.

5. The method of claim 4, further comprising the step of:

producing an AC pump voltage at frequency $\omega$ that is applied to said endcap electrodes, resulting in a quadrupolar field.

6. The method of claim 4, wherein two quadrupolar fields, at frequencies $\Omega$ and $\omega$, are superposed.

7. The method of claim 4 wherein admission of ions into said ion trap is synchronized with pulsing of said pump voltage.

8. The method of claim 7 wherein said admission of said ions into said ion trap is achieved by using a gate generator connected to an electrode having a hole that is covered with a mesh.

9. The method of claim 7, wherein said admission of said ions into said ion trap is achieved by using a gate generator connected to a set of more than one electrode that operates as a gate to bunch said ions into a smaller Z-axis bundle.

10. The method of claim 9 wherein said gate focuses the position and/or energy of said ions.

11. The method of claim 4, further comprising the step of:

providing a master oscillator from which all voltages are derived, wherein all said voltages are phase-coherent.

12. The method of claim 4, wherein each species of ion only responds to a particular parametric resonance frequency, such that said ion trap is mass-selective, such that said ion trap is not filled with interfering species, and such that maximum sensitivity is realized for a species of interest.

13. The method of claim 4, further comprising the step of:

analyzing said trapped ions.

14. The method of claim 4, further comprising the step of:

trapping more than one species of ion simultaneously by applying a parametric field having a complex waveform containing proper frequency components for various species of ion, each frequency being applied with a proper phase.

15. The method of claim 4 wherein said pump voltage is pumped in a burst.

16. The method of claim 4 wherein said ions are ejected from said trap and detected by an ion detector.

* * * * *